US005198016A

United States Patent [19]

Galvin

[11] Patent Number: 5,198,016

[45] Date of Patent: Mar. 30, 1993

[54] PRODUCT FOR THE DESULPHURIZATION OF MOLTEN PIG IRON OR STEEL BASED ON COATED MAGNESIUM

[75] Inventor: Paul H. Galvin, Le Fayet, France

[73] Assignee: Pechiney Electrometallurgie, France

[21] Appl. No.: 788,022

[22] Filed: Nov. 5, 1991

[30] Foreign Application Priority Data

Nov. 5, 1990 [FR] France ..... 90 14092

[51] Int. Cl.[5] ..... C21C 7/02

[52] U.S. Cl. ..... 75/303

[58] Field of Search ..... 75/320

[56] References Cited

U.S. PATENT DOCUMENTS 2,536,362 1/1951 Gallinger ..... 75/537

3,410,681 11/1968 Orban ..... 75/305

4,076,522 2/1978 Yoshida ..... 75/537

*Primary Examiner*—Peter D. Rosenberg

*Attorney, Agent, or Firm*—Pollock, Vande Sande & Priddy

[57] ABSTRACT

A magnesium-containing material for desulphurizing molten pig iron or steel having magnesium particles as a substrate covered with an organic material, which in turn is covered with a refractory powder. The organic material is either a saturated aliphatic acid or an ester of a saturated aliphatic acid which is a solid at room temperature.

10 Claims, No Drawings

PRODUCT FOR THE DESULPHURIZATION OF MOLTEN PIG IRON OR STEEL BASED ON COATED MAGNESIUM

TECHNICAL FIELD

The invention relates to a product for the desulphurization of molten pig iron or steel, based on coated magnesium particles.

PRIOR ART

The use of magnesium powder is well-known for desulphurization of pig iron and steel. However, as a result of its high vapour pressure at the temperature of baths of molten pig iron or steel, magnesium presents problems of use, and an attempt is made to overcome these by coating the magnesium particles, whose diameter is generally less than 2 mm, with a layer of inorganic product in the form of a fine powder consisting of grains whose diameter is generally less than 150 microns.

Various means have been proposed for making the grains of the inorganic product adhere to the magnesium particles. For example, adhesion may be accomplished using organic binders, which possesses some advantages.

Thus, in Patent FR 2,331,618 (AIKOH), the magnesium is first wetted with an organic binder, and the inorganic powder is then added so as to obtain, finally, Mg grains surrounded by an organic film which is itself covered with a layer of inorganic product, which hence adheres to the magnesium via the said organic film.

The organic products more especially mentioned in this patent are:

starch, dextrin, molasses, which are sugars, carboxymethylcellulose, phenolic resins, urea-based resins, melamine resins, furan resins, epoxy resins, polyester resins, pitch and tar.

Application EP 292,205 likewise describes a similar coating in which magnesium is initially covered with a first layer of a hydrophobic product and then a second layer of a particulate refractory product. These hydrophobic products, which are also organic products, are selected from aliphatic or aromatic liquid oils having a low viscosity at 25° C., or oils which are solid at room temperature but liquid at relatively low temperatures (for example waxes or paraffin).

The refractory inorganic products used generally consists of metal oxides, mixtures or complexes of oxides (for example MgO, $Al_2O_3$, $SiO_2$, $TiO_2$, vermiculite, etc.), fluorides, carbon, etc.

However, the desulphurizing products, based on coated magnesium, obtained using these organic products possess drawbacks.

In the first place, they are not completely impermeable to moisture, which causes an evolution of hydrogen in the event of contact with water (liquid or vapour); this evolution of hydrogen obviously presents a risk which must be avoided.

In addition, a small temperature rise can cause softening of the organic material and thereby lead to a deterioration of the refractory coating of the magnesium grains; this results in a risk of the grains sticking to and agglomerating with one another, leading to problems and inconsistencies of implementation when the desulphurizing agent is introduced into the molten metal. These deleterious temperature rises generally occur when the products are stored in exposed places, for example in proximity to furnace, solar radiation, etc.

In the light of these drawbacks, the Applicant has sought an organic product which is sufficiently temperature-resistant while being easy to use and ensuring complete protection against moisture.

SUMMARY OF THE INVENTION

The invention is a product for the desulphurization of molten pig iron or steel, based on magnesium grains coated using an organic product and a refractory powder, characterised in that the organic product is based on saturated aliphatic acids or their esters which are solid at room temperature.

DETAILED DESCRIPTION OF THE INVENTION

Acids or esters which are solid at low temperature, preferably below 60° C. or, better, 80° C., the melting point generally not exceeding 110° C., melting sharply without passing through a softening phase, are customarily used.

The esters customarily used are triesters of glycerol or mixtures thereof, especially the saturated triesters obtained by hydrogenation of castor oil, which lead essentially to glyceryl trihydroxystearate. Hydrogenated sunflower oil, glyceryl tristearate and sometimes stearic acid are also useable.

These products have a high molecular weight, with a number of C atoms generally not less than 16 for the acids or 51 for their triesters.

It is seen that the solid coating products of the invention make it possible, on the one hand to produce a coating of Mg which is stable at high temperature without the need in engage in chemical conversions of starting materials in order to obtain it. It may be recalled, on the other hand that, with this stable coating, an Mg powder can withstand harsh temperature conditions of storage (proximity to furnaces, sunlight, etc.) without undergoing a deterioration in its flowability.

The esters of the invention generally constitute the majority, or preferably the whole, of the organic product used for coating the magnesium. Thus, the said organic product can contain organic products other than the esters of the invention, especially unconverted residues of the products which have been used for obtaining the said esters.

They are especially suitable for coating magnesium, to which they adhere to an exceptional extent as a result of their acidity, which is not zero but low, permitting a very superficial reaction with the Mg particles. For example, hydrogenated castor oil has an acid value of 4 (which represents the weight of KOH in mg for neutralizing 1 g of product) and melts at 86° C.

As a refractory coating product, it is possible to use all infusible metal oxides or other refractories in powder form known in the prior art, but also desulphurizing agents such as $CaC_2$, $CaCO_3$, CaO, etc., or other minerals such as carbons, etc., or mixtures thereof.

In the case where the refractory product is moisture-sensitive, such as, for example, $CaC_2$, it is advantageous to coat it before hand with an organic product, preferably those already mentioned, before coating Mg with it according to the invention.

However, the Applicant has found that it is advantageous to employ as a refractory product, hence used for coating the grains of magnesium agents employing the esters according to the invention, a slag in the form of grains having the following composition (in weight %):

| | |
|---|---|
| CaO | 54 to 60% |
| MgO | 3 to 7% |
| $SiO_2$ | 24 to 30% |
| $Al_2O_3$ | 9 to 13% |

An electric-furnace slag in powder form possesses the following advantages:

at the temperature of baths of molten pig iron or steel, it is more or less in thermodynamic equilibrium with the magnesium and hence barely reacts with the latter; a spurious consumption of magnesium is thereby avoided;

if it is manufactured by fusion, it gives rise, after casting, to an allotropic conversion, which, during the cooling, converts it naturally to a fine powder consisting of grains of mean diameter approximately 40 μm.

It has a thermal conductivity of approximately 0.5 $Wm^{-1}K^{-1}$, significantly lower than that of the usual oxides under the same conditions, and hence promotes a delay effect in the action of the magnesium, the reactions of which are considered to be too rapid and too violent.

The magnesium particles are usually less than 2 mm and preferably between 300 and 800 μm approximately in size, and the powder of refractory product is between 0 and 80 μm approximately in size.

In general, 0.5 to 1.5 parts by weight of ester according to the invention (for example hydrogenated castor oil) are used per 5 parts by weight of protective refractory product, and most often 1 part of ester per 5 parts of protective slag. The proportion of coating product relative to the desulphurizing agent can range from 2% to 25% (weight).

The desulphurizing product based on coated magnesium according to the invention may be mixed with other desulphurizing agents, especially with calcium carbide, or with other mixtures based on calcium carbide (for example a mixture of the calcium carbonate+calcium carbide+carbon type), with or without lime. It may also be mixed with inert products.

To obtain the desulphurizing product according to the invention, it is possible to proceed in the following manner:

the magnesium particles and the ester according to the invention are introduced simultaneously in the solid state into a heated mixer so as to produce initially particles uniformly covered with ester; the powder of refractory product is then introduced and particles covered with slag are then obtained, these particles being removed from the mixer and thereafter cooled.

Thus, the invention makes it possible to obtain desulphurizing product which are inert to water and to moisture, do not give rise to an evolution of hydrogen and do not agglomerate even under harsh conditions of storage or use. These products afford an improved safety in use.

EXAMPLE 1

Various products for desulphurization, based on magnesium, hydrogenated castor oil and slag powder between 0 and 80 μm in size, described above, were prepared according to the process also described above.

These products were injected as a dose of 0.1% into a molten pig iron to be desulphurized at 1350° C. containing 0.05% of sulphur. The characteristics and the results are given in the following table:

| PRODUCT No. | MAGNESIUM Particle size μm | MAGNESIUM % | HYDROGENATED CASTOR OIL % | SLAG POWDER % | SULPHUR CONTENT OF THE TREATED PIG IRON % |
|---|---|---|---|---|---|
| 1 | 300–800 | 97 | 0.5 | 2.5 | 0.01 |
| 2 | 250–800 | 80 | 3 | 17 | 0.006 |
| 3 | 250–630 | 71 | 4 | 25 | 0.007 |

All these products are inert to water, that is to say, when they are immersed in water at pH7, no evolution of hydrogen is observed, the result being confirmed after 2 hours' immersion.

It is noted that the delay effect increases with the amount of refractory product and tends to improve the quality of the pig iron obtained, up to a certain limit.

In comparison, the same test of immersion for 2 h was performed with magnesium particles coated according to the prior art.

Thus, coated magnesium was prepared according to Example 1 of Application EP 292 205; 25 g of this were immersed in water at pH7 and 19° C., and a steady evolution of 50 $cm^3$ of hydrogen per hour was observed.

A similar evolution of hydrogen was observed under the same conditions with magnesium coated with a phenolic resin and magnesium oxide according to the teaching of Patent FR 2,331,618.

EXAMPLE 2

A desulphurizing product containing 20% of the product No. 1 and 80% of a pulverulent mixture of the following composition (weight %) was prepared:

| | |
|---|---|
| Ca carbide powder (less than 100 μm) | 80% |
| Ca carbonate powder (less than 100 μm) | 17% |
| lampblack | 3% |

This product was injected into the same molten pig iron as in Example 1, at a dose of 0.25%. The final sulphur content obtained was 0.012%.

EXAMPLE 3

A mixture based on magnesium, hydrogenated castor oil and micronized calcium carbide was prepared according to the process described above, its composition being as follows:

| | |
|---|---|
| Mg (300–800 μm) | 80% |
| Hydrogenated caster oil | 3% |
| $CaC_2$ (less than 100 μm) | 17% |

Such a product according to the invention is especially suitable for use in the form of a mixture with a powder also of calcium carbide. It affords great safety for storage in a hot environment; on the other hand, it is sensitive to water as a result of the presence of calcium carbide at the surface.

This product was injected into the same molten pig iron as in Example 1, in the same proportion of 0.1%. The final sulphur content obtained is 0.005%.

The above drawback was avoided, in a supplementary test, without adversely affecting the safety for storage in a hot environment, by coating $CaC_2$ using 1% (relative to $CaC_2$) of hydrogenated castor oil before introducing it into the mixture containing coated Mg.

I claim:

1. A product for desulphurizing molten pig iron or steel comprising magnesium grains, an organic material coating said magnesium grains, and a refractory powder adhering to said organic material, wherein said organic material is selected from saturated aliphatic acids and estes of said aliphatic acids, said organic material being solid at room temperature.

2. A product according to claim 1, wherein said organic material has

3. A product according to claims 1 or 2 wherein said organic material is selected from triesters of glycerol and mixtures thereof.

4. A product according to claims 1 or 2 wherein said organic material is selected from hydrogenated castor oil, hydrogenated sunflower oil, glyceryl trihydroxystearate, glyceryl tristearate, stearic acid and mixtures thereof.

5. A product according to claims 1 or 2 wherein said refractory powder is a desulphurizing agent selected from $CaC_2$, $CaCO_3$, CaO and mixtures thereof.

6. A product according to claims 1 or 2 wherein said refractory powder is a powdered electric-furnace slat containing, by weight, 54–60% CaO, 3–7% MgO, 24–30% $SiO_2$ and 9–13% $Al_2O_3$.

7. A product according to claims 1 or 2 wherein said magnesium grains are less than 2 mm in size and said refractory powder has a particle size less than 80 μm.

8. A product according to claims 1 or 2 wherein said organic material is an ester and is present in an amount of 0.5 to 1.5 parts by weight of said ester per 1–5 parts by weight of refractory powder, and the resulting coating combination of ester and refractory powder is from about 2% to about 25% of the weight of said magnesium grains.

9. A process for producing a material for desulphurizing molten pig iron or steel comprising forming spherical particles of magnesium grains coated with an organic material selected from saturated aliphatic acids and their acids, said organic material being solid at room temperature, and covering the resulting coated particles of magnesium with a powder of a refractory material.

10. A process according to claim 9 wherein sid powder of a refractory material is provided with a coating of an organic product before covering the coated material.

* * * * *

UNITED STATES PATENT AND TRADEMARK OFFICE

CERTIFICATE OF CORRECTION

PATENT NO. : 5,198,016

DATED : March 30, 1993

INVENTOR(S) : Galvin

It is certified that error appears in the above-identified patent and that said Letters Patent is hereby corrected as shown below:

In column 5, claim 1, line 17, "estes" should be --esters--.

In column 5, claim 2, line 20, after "has" insert --a melting point above 60° C.--.

Signed and Sealed this

First Day of February, 1994

Bruce Lehman

*Attest:*

BRUCE LEHMAN

*Attesting Officer*

*Commissioner of Patents and Trademarks*